United States Patent [19]

Lenhardt

[11] Patent Number: 4,774,738

[45] Date of Patent: Oct. 4, 1988

[54] GLASS PLATE WASHING MACHINE

[75] Inventor: Karl Lenhardt, Neuhausen-Hamberg, Fed. Rep. of Germany

[73] Assignee: Lenhardt Maschinenbau GmbH, Neuhausen-Hamburg, Fed. Rep. of Germany

[21] Appl. No.: 900,672

[22] Filed: Aug. 27, 1986

[30] Foreign Application Priority Data

Aug. 28, 1985 [DE] Fed. Rep. of Germany ... 8524540[U]

[51] Int. Cl.[4] ..... B24B 7/26

[52] U.S. Cl. ..... 15/77; 15/102

[58] Field of Search ..... 15/77, 88, 100, 102

[56] References Cited

U.S. PATENT DOCUMENTS 3,093,852 6/1963 Madge ..... 15/77

3,497,897 3/1970 Wehr ..... 15/77

*Primary Examiner*—Edward L. Roberts

*Attorney, Agent, or Firm*—Balogh, Osann, Kramer, Dvorak, Genova & Traub

[57] ABSTRACT

The glass plate washing machine has a horizontal conveyor which comprises glass-plate supporting elements, which define a glass-plate travel plane, to support the glass plates over one of their two large faces during passage through the washing machine. Disposed at each side of the glass-plate travel plane are two sets of brush rollers which are driven and the axes of which extend transversely to the direction of travel of the horizontal conveyor, the spacing between the two sets of the brush rollers, which are mounted in front of and in back of the glass-plate travel plane, from the glass-plate travel plane, being variable, wherein one set of brush rollers is movable with respect to the other set of brushes to accommodate different thicknesses of glass-plate. The brush rollers in said movable set are adjustable individually and are driven individually.

8 Claims, 2 Drawing Sheets

GLASS PLATE WASHING MACHINE

DESCRIPTION

Figure 1:
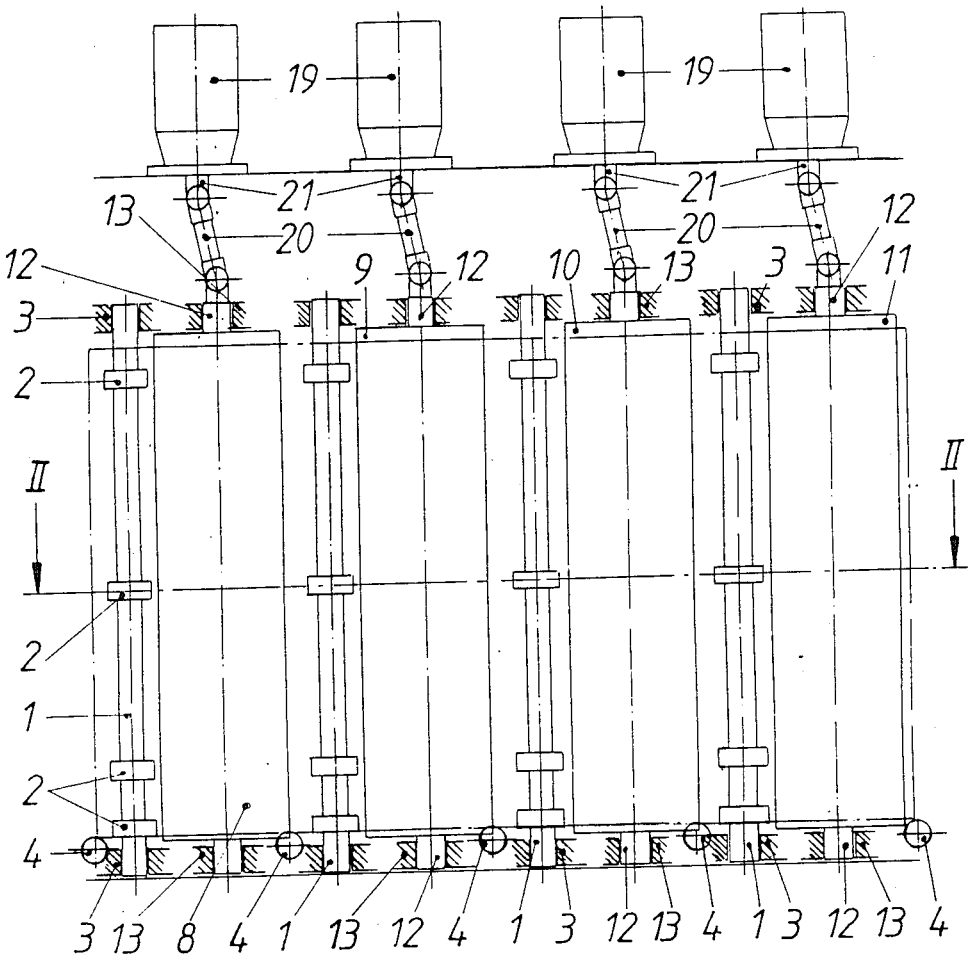

The invention is based on a glass-plate washing machine having the features given in the preamble to claim 1. Such a glass-plate washing machine is needed at the beginning of an insulating-glass assembly line. In such a washing machine, the glass plates are washed while passing through and then dried. For this purpose, glass-plate washing machines are equipped with two rows of brush rollers of which the one row acts on the one large face and the other row acts on the other large face of the glass plates. A further necessary component of the glass-plate washing machine is a conveyor which conveys the glass plates, lying flat or upright, through the machine in a horizontal direction. In the course of this, the glass plates are supported at one of their two large surfaces; the supporting elements used for this are generally rollers with axes disposed transversely to the direction of travel of the horizontal conveyor. With their rolling surfaces, these rollers together define a plane which is designated hereinafter as the glass-plate travel plane; it is that plane in which the glass plates lie with their large face on which the rollers act. The glass-plate travel plane is a plane which is preset by the supporting rollers in the glass-plate washing machine. The brush rollers, which act on the large face of the glass plates lying in the glass-plate travel plane, can therefore be mounted stationary. On the other hand, the brush rollers disposed at the opposite side of the glass-plate travel plane may appropriately be variable in their spacing from the glass-plate travel plane in order to be able to wash glass plates of different thicknesses in the washing machine.

Modern insulating-glass assembly lines are constructed so that they process and handle the glass plates extending in a substantially vertical position. Accordingly, the glass-plate washing machines which are used in such modern assembly lines also have a glass-plate travel plane extending substantially vertically.

The brush rollers are usually arranged in pairs in glass-plate washing machines, that is to say situated opposite each brush roller on the one side of the glass-plate travel plane is a brush roller at the other side of the glass-plate travel plane. In the known glass-plate washing machines, the drive of the brush rollers is effected separately from the drive of the horizontal conveyor; nevertheless, all the brush rollers are driven by a common motor and are connected to one another by transmission elements for this purpose; in particular, the brush rollers situated opposite one another are coupled together by interengaging gearwheels.

It is a disadvantage of the known glass-plate washing machines that glass plates of any desired different thickness cannot be washed in close succession in them. If one glass plate is followed by a glass plate which is very much thicker or thinner, the spacing of the brush rollers must first be appropriately adapted and in the known machines. This is only possible when there is no glass plate between the brush rollers. Before the spacing of the brush rollers is adjusted, therefore, the first glass plate must first leave the washing machine and the following glass plate can only enter the washing machine when the brush rollers have been adjusted. Unwanted delays in the work flow result from this.

It is true that in the known glass-plate washing machines the brush rollers are resiliently mounted but the spring extension is so short that an automatic adaptation of the brush rollers is only possible thereby to glass plates which are between 3 and 13 mm thick.

A further disadvantage of the known glass-plate washing machines consists in that a comparatively great expenditure of energy is necessary for the adjustments of the brush rollers because the brush rollers at the one side of the glass-plate travel plane are connected to those at the other side of the glass-plate travel plane by interengaging transmission elements and this transmission connection must not be braken by the adjustment, which ultimately leads to the fact that the known washing machines are only adaptable to a limited extent.

It is the object of the invention to improve a glass-plate washing machine of the type mentioned at the beginning in the sense that the spacing of its brush rollers is easily variable in such a manner that glass plates of different thicknesses can be washed in close succession while passing through.

This object is achieved by a glass plate washing machine having a conveyor providing a horizontal direction of travel of the glass plates and comprising glass plate supporting elements, which define a glass plate travel plane and which support the glass plates over one of their two large faces during passage through the washing machine, and having two sets of brush rollers which are disposed on both sides of the glass plate travel plane and which are driven and the axes of which xtend transversely to the said direction of travel, wherein the brush rollers in one set are driven individually by means of motors associated specifically with each of the brushes which are mounted so that their spacings from the glass plate travel plane are individually variable, and individual means for movably supporting each brush with respect to said glass-plate travel plane so that various thicknesses of glass plates can be accommodated between said two sets of brushes.

As a result of the fact that in the glass-plate washing machine according to the invention, the brush rollers disposed at the one side of the glass-plate travel plane are driven individually, there are no transmission connections between these and other brush rollers which have to remain in existence when an adjustment is made; the increased expenditure of energy caused thereby in the known washing machines during adjustment does not occur in the glass-plate washing machine according to the invention; here the brush rollers can be adjusted with little expenditure of energy. The fact that the brush rollers disposed at the one side of the glass-plate travel plane are driven individually also provides the necessary conditions for mounting them so as to be adjustable individually even over relatively large distances. As a result, the effect is achieved that glass plates of all the thicknesses which occur in practice (thicknesses up to 80 mm occur in practice) can be washed during passage through the washing machine in close succession because as soon as a glass plate has left the region of contact with one pair of brush rollers, the spacing between the brush rollers of this pair of brush rollers can be adapted to the thickness of the following glass plate. Whereas in the known washing machines, the brush rollers disposed at the one side of the glass-plate travel plane could only be adjusted jointly, in the washing machine according to the invention, the brush rollers of adjacent pairs of brush rollers may have different spacing as required.

The adjustment of the brush rollers may be effected by electric servo motors or by pneumatic or hydraulic piston-cylinder units which may appropriately receive their control instructions from sensors which detect and signal the moment of entry of the glass plates and their length.

Preferably, not only the brush rollers disposed at the one side of the glass-plate travel plane can be driven individually, but all the brush rollers so that no transmission elements are any longer needed to connect brush rollers to one another. In addition, this affords the possibility of being able to select the direction of rotation and the speed of rotation of the brush rollers individually.

The drive of the brush rollers may appropriately be effected by electric motors. Fundamentally, the electric motors associated with the adjustable brush rollers could participate in the adjustment movement of the brush rollers. Preferably, however, the motors are fixed to the frame and their driven shaft is connected to the associated brush roller by means of a cardan shaft.

Shafts extending parallel to the brush rollers and having rollers mounted thereon for rotation therewith but not in relation thereto, which are driven in synchronism for the advance of the glass plates, may appropriately be used to support the glass plates over one of their large faces. Particularly in washing machines, the glass-plate travel plane of which extends substantially vertically, it is advisable to provide such driven shafts at both sides of the glass-plate travel plane in order to produce the necessary frictional connection between the drive rollers and the glass plates, which has to overcome the braking acction of the brush rollers for the advance of the glass plates. If drive shafts are disposed at both sides of the glass-plate travel plane, they must naturally be mounted for adjustment in a similar manner to the brush rollers. For this purpose, the driven shafts disposed at the same side of the glass-plate plane as the adjustable brush rollers are preferably mounted in common bearing blocks with adjacent brush rollers so that when a brush roller is adjusted, the shaft(s) mounted in the same bearing block is(are) also automatically adjusted at the same time. The adjustment of the bearing blocks is preferably effected by displacement parallel to themselves because as a result, the common row of brush rollers and shafts with the drive rollers thereon, which must extend parallel to the plane of the glass plates, always remains parallel to the glass-plate travel plane.

Two examples of preferred embodiments of glass-plate washing machines having a substantially vertical glass-plate travel plane, are illustrated diagrammatically in the accompanying drawings and will be described below.

Figure 2:
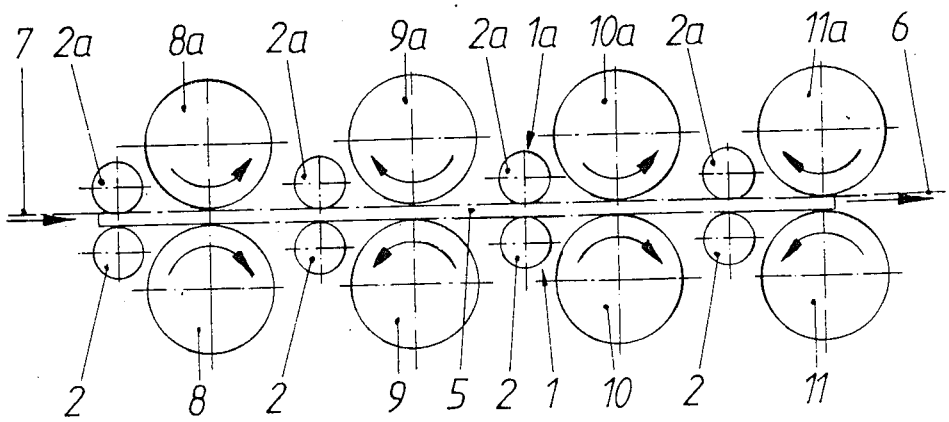
Figure 3:
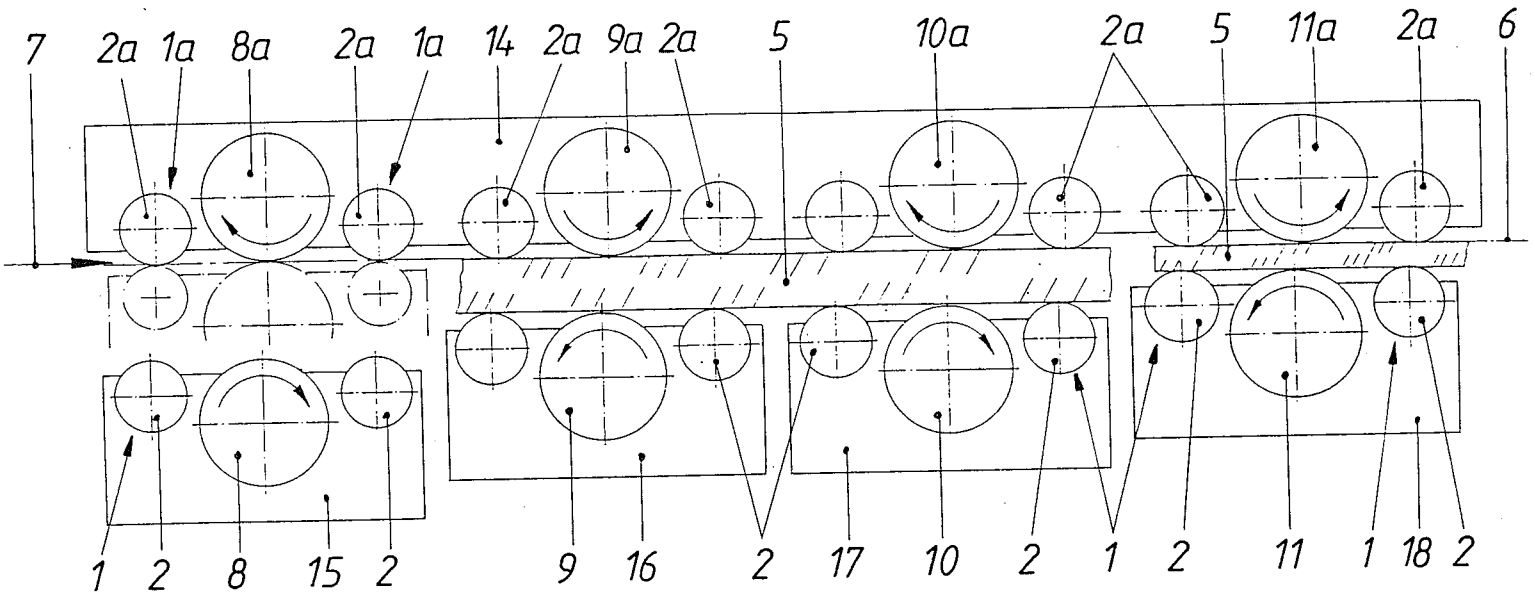
Figure 4:
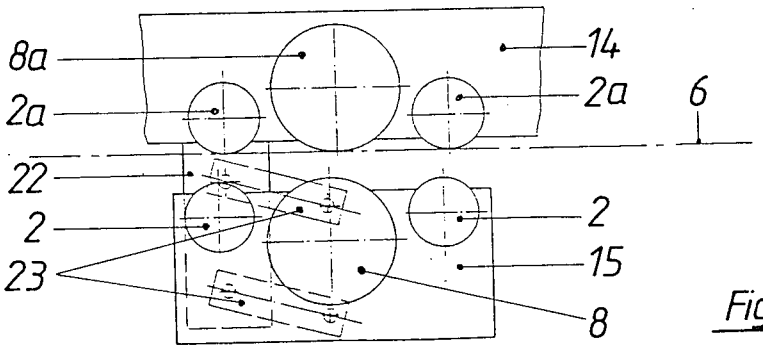

FIG. 1 shows the arrangement of the brush rollers and drive shafts in the washing machine for the first example of embodiment, seen from the front, FIG. 2 shows the cross-section II—II through the arrangement illustrated in FIG. 1, FIG. 3 shows, on a larger scale, an illustration similar to that in FIG. 2 but with two different thicknesses of glass plate in the washing machine, for the second example of embodiment, and FIG. 4 shows, as a detail, in an illustration as in FIG. 3, the manner in which the brush rollers which are situated at the front of the glass-plate travel plane are adjustable.

FIGS. 1 and 2 show the arrangement of two rows of shafts 1 and 1*a* parallel to one another and with substantially vertical axes inclined slightly towards the rear, in a washing machine. The shafts 1 and 1*a* carry, distributed over their length, some rollers 2 and 2*a* respectively which are mounted on the shafts 1 and 1*a* respectively for rotation therewith but not in relation thereto. In the example illustrated, each shaft 1, 1*a* carries four such rollers 2 or 2*a*. The rolling surfaces of the rollers 2*a* of the rear shafts are arranged so that, at their front, they have a common tangential plane 6 which is here designated as the glass-plate travel plane. Glass plates 5, which are conveyed through the washing machine, lean with their rear large face, which coincides with the glass-plate travel plane 6, against the rear rollers 2*a*. The glass plates 5 stand with their lower edge on a horizontal row of rollers 4, the axes of rotation of which extend perpendicular to the glass-plate travel plane 6. Each of the rollers 2 disposed in front of the glass-plate travel plane 6 is situated opposite a corresponding roller 2*a* from the group of rollers situated behind the glass-plate travel plane, that is to say, the shafts 1 and 1*a* as well as the rollers 2 and 2*a* each form pairs of elements situated in front of and behind the glass-plate travel plane 6.

The shafts 1 and 1*a* as well as the rollers 4 can be driven in synchronism with one another; together they form a horizontal conveyor by means of which the glass plates 5 are conveyed through the washing machine.

In order to clean the glass plates 5, the washing machine is equipped with four pairs 8 and 8*a*, 9 and 9*a*, 10 and 10*a*, 11 and 11*a* of brush rollers, the axes of which extend parallel to the shafts 1 and 1*a*. Four brush rollers 8*a*, 9*a*, 10*a* and 11*a* are disposed behind the glass-plate travel plane 6 and the other four brush rollers 8 to 11 in front of it. In the example shown in FIG. 1 and FIG. 2, the pairs of brush rollers and the pairs of shafts 1, 1*a* are disposed alternately one after the other in the direction of travel 7. The number of four pairs of brush rollers is a preferred selection but fundamentally the washing machine may also comprise more or fewer pairs of brush rollers. The same applies to the number of shafts 1 and 1*a*. Thus, in the modified example shown in FIG. 3 and FIG. 4, each brush roller is flanked by two shafts 1 and 1*a*.

The brush rollers 8 to 11 and 8*a* to 11*a* can be driven individually, separately from the shafts 1 and 1*a* and separately from the rollers 4, by motors 19 which are mounted fixed to the frame above the brush rollers. The frame of the washing machine is not illustrated in detail since it is not part of the invention and is not essential for understanding it. At least the brush rollers 8 to 11 disposed in front of the glass-plate travel plane 6 are connected by cardan shafts 20 to the driven shafts 21 of the motors 19 associated with them in order to be able to effect the adjustment of the spacing of these brush rollers 8 to 11 from the glass-plate travel plane 6 without any problems. The rear brush rollers 8*a* to 11*a* do not have to be mounted for adjustment because the glass-plate travel plane 6 does not alter its position when the thickness of the glass plate changes; therefore, the rear brush rollers 8*a* to 11*a* do not have to be connected to their motors through cardan shafts or the like either.

The method of mounting the shafts 1 and 1*a* as well as the brush rollers 8 to 11 and 8*a* to 11*a* is illustrated somewhat more fully in the example of embodiment shown in FIG. 3 and can also be taken over in a corresponding manner for the example of embodiment shown in FIG. 1 and FIG. 2. Because of the similarity of the two examples of embodiment, the same or corresponding components are designated by the same reference numerals. The second example of embodiment differs from the first example of embodiment essentially only in that not only one but two shafts 1 and 1*a* are associated with each brush roller 8 to 11 and 8*a* to 11*a* respectively.

The shafts 1 and 1*a* are mounted at the top and bottom in bearings 3 and the upper and lower roller journals 12 of the brush rollers are mounted in bearings 13. The bearings of the shafts 1*a* and brush rollers 8*a* to 11*a* disposed behind the glass-plate travel plane 6 can be disposed jointly in an upper and a lower bearing block 14, fixed to the frame, whereas the brush rollers 8 to 11 disposed in front of the glass-plate travel plane 6 are mounted individually, at the top and bottom, in separate bearing blocks 15, 16, 17 and 18 which are displaceable transversely to the glass-plate travel plane. In the example shown in FIG. 3 and FIG. 4, the two shafts 1, which are associated with each of the front brush rollers 8 to 11, are mounted in the same bearing block 15, 16, 17 and 18 respectively as these and are therefore displaceable jointly with them. The displacement of the bearing blocks 15 to 18 is effected parallel to themselves, for example as a result of the fact that two links 23, which are disposed parallel to one another and which are pivotally mounted by their one end on the associated bearing block, for example on the bearing block 15, and by their other end on a support 22 fixed to the frame, are pivoted (FIG. 4).

If the method of mounting the brush rollers 8 to 11 and 8*a* to 11*a* as well as the shafts 1 and 1*a* illustrated in FIGS. 3 and 4 is transferred to the first example of embodiment, then each of the bearing blocks 15, 16, 17 and 18 in the first example of embodiment only carries one shaft 1 apart from its brush roller 8, 9, 10 or 11.

The illustration in FIG. 3 shows that glass plates 5 and 5' with different thicknesses can travel through the washing machine in close succession. Since the bearing blocks 15, 16, 17 and 18 are adapted for transverse displacement individually, they can successively increase their spacing from the glass-plate travel plane 6 as soon as the glass plate 5 has travelled out of the range of action of the particular pair of brush rollers 8, 8*a* or 9, 9*a* or 10, 10*a* or 11, 11*a* respectively. If a thicker glass plate is followed by a thinner one, then the bearing blocks 15 to 18 can naturally only be moved towards the glass-plate travel plane 6 when the thicker glass plate in the bearing block in question has left not only the range of action of the particular pair of brush rollers but also the range of the associated pair of rollers 2 and 2*a*.

The maximum range of displacement of the bearing blocks is also indicated in FIG. 3 with reference to the bearing block 15 at the entry side (not to scale). In a washing machine according to the invention, the thickest and thinnest glass plate occurring in practice can be washed as they pass through immediately behind one another. Glass plates which are thicker than 80 mm do not occur in practice.

As a result of the fact that the brush rollers can be driven individually in the washing machine according to the invention, there is the advantageous possibility of selecting the direction of rotation and the speed of rotation of the brush rollers 8 to 11 and 8*a* to 11*a* independently of one another. FIG. 2 shows the selection of a direction of rotation wherein the two brush rollers 8, 8*a* and 9, 9*a* and 10, 10*a* and 11 11*a* respectively in each pair of brush rollers are driven in opposite directions and in which brush rollers which are adjacent in the direction of travel 7 are also driven in opposite directions. The latter is not the case in known glass-plate washing machines and has the advantage that a more intensive cleaning of the glass plates is achieved. FIG. 3 shows another possibility for the drive: The brush rollers which are adjacent in the direction of travel 7 are again driven in the opposite direction in each case, which has the advantage of the thorough cleaning of the glass plates. Within a pair of brush rollers 8, 8*a*, or 9, 9*a*, or 10, 10*a* or 11, 11*a* respectively, however, the brush rollers are not driven in opposite directions but in the same direction; the later is not the case in known glass-plate washing machines and has the advantage that the decelerating and the accelerating actions of the brush rollers on the glass plates 5 cancel each other out within each pair of brush rollers.

I claim:

1. A glass plate washing machine having a conveyor providing a horizontal direction of travel of the glass plates and comprising glass plate supporting elements, which define a glass plate travel plane and which support the glass plates over one of their two large faces during passage through the washing machine, and having two sets of brush rollers which are disposed on both sides of the glass plate travel plane and which are driven and the axes of which extend transversely to the said direction of travel, wherein the brush rollers in one set are driven individually by means of motors associated specifically with each of the brush rollers and wherein the brush rollers in said one set are mounted with their roller journals in separate bearing blocks in which said glass plate supporting elements disposed on the same side of the glass plate travel plane are also mounted, and wherein said bearing blocks are so mounted that their spacings from the glass plate travel plane are individually variable, so that various thicknesses of glass plates can be accommodated between said two sets of brushes.

2. A glass-plate washing machine as claimed in claim 1, wherein the brush rollers in the other set are driven separately.

3. A glass-plate washing machine as claimed in claim 1, wherein the brush rollers in said one set are connected to a driven shaft of the motor associated with each of them, by means of a carden shaft.

4. A glass-plate washing machine as claimed in claim 3 wherein said motors are mounted above said brush rollers.

5. A glass-plate washing machine as claimed in claim 1, wherein the glass-plate travel plane extends substantially vertically.

6. A glass-plate washing machine as claimed in claim 5, wherein said motors are mounted above said brush rollers

7. A glass-plate washing machine as claimed in claim 1, wherein said motors are mounted above said brush rollers.

8. A glass plate washing machine having a conveyor providing a horizontal direction of travel of the glass plates and comprising glass plate supporting elements, which define a glass plate travel plane and which support the glass plates over one of their two large faces during passage through the washing machine, and having two sets of brush rollers which are disposed on both sides of the glass plate travel plane and which are driven and the axes of which extend transversely to the said direction of travel, wherein the brush rollers in one set are driven individually by means of motors associated specifically with each of the rollers mounted so that their spacings from the glass plate travel plane are individually variable, and individual means for movably supporting each brush roller with respect to said glass plate travel plane so that various thicknesses of glass plates can be accommodated between said two sets of brush rollers, said glass plate supporting elements including two sets of shafts which are driven in synchronism with one another parallel to the brush rollers, said shafts being provided with rollers mounted thereon for rotation therewith but not relative thereto, for the advance of the glass plates, wherein the brush rollers in said one set are mounted with their roller journals in separate bearing blocks in which the shafts in one set, disposed on the same side of the glass plate travel plane, are also mounted, and wherein said bearing blocks are so mounted that they are displaceable parallel to themselves and transversely to the glass plate travel plane, as a result of which their spacing from the glass plate travel plane is adjustable.

* * * * *